United States Patent [19]

Thiele

[11] Patent Number: 4,716,660

[45] Date of Patent: Jan. 5, 1988

[54] UNIFELT AIR SUCTION SYSTEM

[75] Inventor: Eric W. Thiele, Freemont, Wis.

[73] Assignee: Hercules Incorporated, Wilmington, Del.

[21] Appl. No.: 847,671

[22] Filed: Apr. 3, 1986

[51] Int. Cl.[4] ..... F26B 13/08

[52] U.S. Cl. ..... 34/114; 34/116; 34/122; 34/123

[58] Field of Search ..... 34/114, 116, 117, 120, 34/122, 123

[56] References Cited

U.S. PATENT DOCUMENTS

| | | | |
|---|---|---|---|
| 1,525,483 | 2/1925 | White | 34/114 |
| 3,110,575 | 11/1963 | Justus | 34/111 |
| 3,384,973 | 5/1968 | Johansson | 34/23 |
| 3,733,711 | 5/1973 | Haythornthwaite | 34/23 |
| 3,874,997 | 4/1975 | Kankaanpaa | 162/290 |
| 4,190,964 | 3/1980 | Schiel | 34/114 |
| 4,202,113 | 5/1980 | Kankaanpaa | 34/114 |
| 4,359,827 | 11/1982 | Thomas | 34/114 |
| 4,359,828 | 11/1982 | Thomas | 34/114 |
| 4,441,263 | 4/1984 | Vedenpaa | 34/116 |
| 4,566,946 | 1/1986 | Koponen et al. | 34/114 |
| 4,628,618 | 12/1986 | Virta et al. | 34/116 |

*Primary Examiner*—Albert J. Makay
*Assistant Examiner*—David W. Westphal
*Attorney, Agent, or Firm*—Connolly & Hutz

[57] ABSTRACT

A unifelt system for drying paper includes banks of upper and lower drying cylinders around which the paper is conveyed in contact with a support sheet. At least one suction nozzle is provided at the pocket formed at the upstreammost lower cylinder and the support sheet to prevent air from being trapped between the paper and the support sheet for minimizing bulging which might otherwise occur.

18 Claims, 9 Drawing Figures

UNIFELT AIR SUCTION SYSTEM

BACKGROUND OF THE INVENTION

The present invention is particularly directed to the unifelt type systems for drying papers. In such systems paper sheets such s fine paper or newsprint paper leaves the press while wet and in a relatively weak condition. The paper is dried by being conveyed over a series of drying cylinders. In one known arrangement felt support members are disposed on each side of the paper while it is being conveyed through the drying installation. A modification known as the unifelt system uses only a single fabric support member in the portion of the machine where paper is weakest, i.e., at its wet end. It has been found in practice that the provision of the support member is necessary only while the paper is being conveyed over the first six or eight drying cylinders at the wet end. Thereafter the paper may be conveyed by the conventional double felt arrangement.

The unifelt systems generally used encounter a process problem resulting in air traveling with the fabric support member. With conventional unifelt there is no outlet for the trapped air. As a result the paper sheet is caused to bulge, flutter and wrinkle. This problem is particularly acute at the wet end of the machine where the paper sheet is very weak and can readily break.

SUMMARY OF THE INVENTION

An object of this invention is to provide a unifelt system which includes means for avoiding the entrapment of air between the paper sheet and the support member.

A further object of this invention is to provide such a system which is easily adaptable to present unifelt machines.

In accordance with this invention, a suction nozzle is provided at the bottom pocket adjacent the upstreammost lower drying cylinder (i.e., lower drying roller at the wet end). The nozzle has an arcuate perforated surface conforming to the adjacent cylindrical surface of the dryer. A planar perforated surface diverges away from the arcuate surface at the nose of the nozzle. As a result the nose or suction end of the nozzle thus conforms in shape to the adjacent drying cylinder and to the support sheet at the pocket. This close conformance in shape permits the nozzle to be inserted deeply into the pocket to effectively evacuat the air from the pocket and prevent the detrimental bulging that might otherwise occur.

In a preferred form of this invention sealing means are provided on the nozzle for being near the cylinder and support sheet to optimize the suction action of the nozzle. Since the air pocket problem is most acute at the wet end of the machine, a suction nozzle is provided for the three upstreammost lower pockets. Each nozzle may be divided by a partition into a suction zone where the perforated surfaces are located and into a downstream plenum zone. A common manifold may be connected to all of the nozzles for the exit of the withdrawn air.

THE DRAWINGS

DETAILED DESCRIPTION

Figure 1:
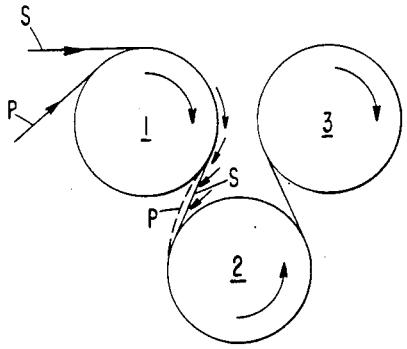
FIG. 1 (PRIOR ART)
FIG. 1 is a side elevation view of a prior art unifelt system.

FIG. 1 illustrates a portion of a conventional unifelt system at the wet end of the machine. As shown therein, paper P and support sheet S are conveyed partially around upper dryer 1. The jointly moving paper P and support sheet S are then conveyed around lower dryer 2 and then around upper dryer 3 and any other suitable number of lower and upper dryers. In practice it has been found that air travels with the support S. Since there is no outlet for the air, the air becomes trapped between paper P and sheet S causing the paper sheet to bulge, flutter and wrinkle and even sometimes break.

In general the present invention overcomes the prior art air bulging problem discussed with respect to FIG. 1 by providing at least one and preferably three suction nozzles at the upper drying pockets at the wet end of the unifelt machine. It has been found that the bulging problems occur only at the upper drying pockets and that the problem is most acute in the first three sets of drying cylinders. Accordingly in the preferred practice of this invention three such suction nozzles are utilized.

Figure 2A:
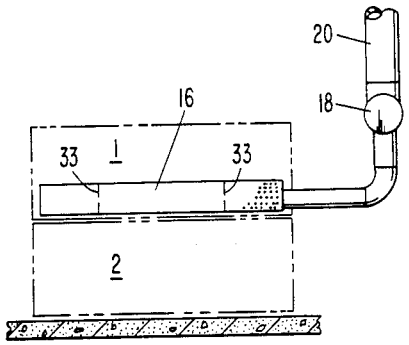
FIG. 2A is a front view along the line 2A—2A of FIG. 2.
Figure 2:
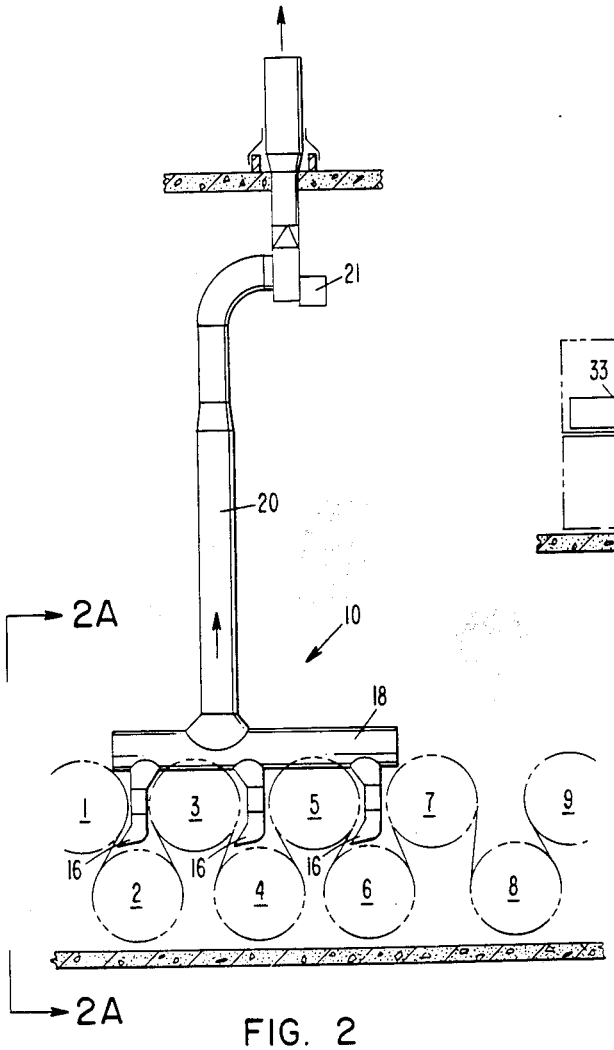
FIG. 2 is a side elevation view from the drive side of a portion of a unifelt system in accordance with this invention.

FIG. 2 illustrates a portion of a unifelt machine 10 from the drive side or wet end which incorporates the inventive arrangements. Machine 10, in general, includes banks of upper and lower drying cylinders arranged in the known manner. There would, for example, be twenty-two upper cylinders and twenty-one lower cylinders arranged in staggered fashion. Only nine such cylinders 1-9 are illustrated. A suction nozzle 16 is provided in the three upper drying pockets adjacent the three upstreammost lower drying cylinders 2, 4, 6. Suction nozzle 16 communicates with a common manifold 18 which permits the evacuated air to be conveyed through duct 20 and then ultimately vented from machine 10.

Figure 3:
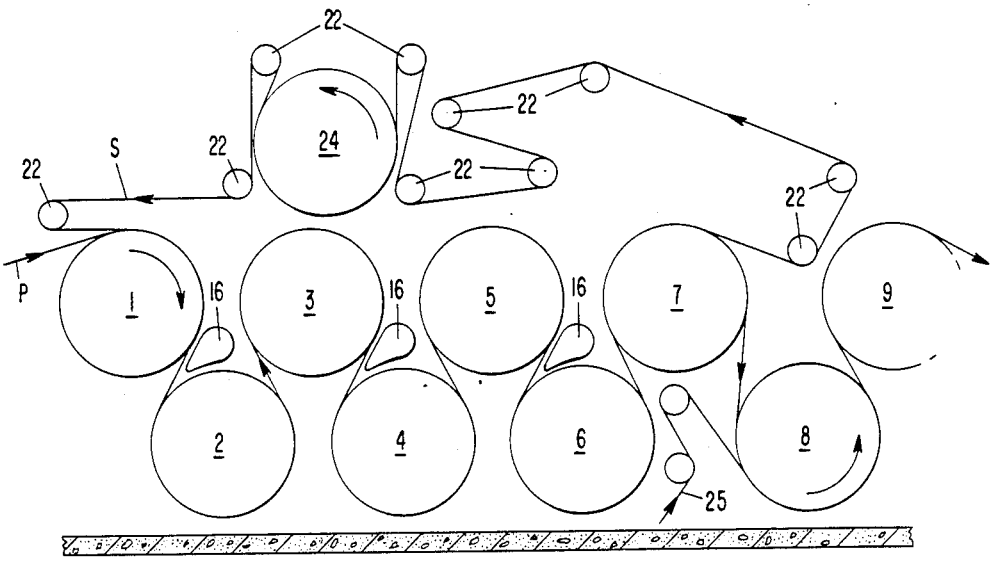
FIG. 3 is a side elevation view of the drying cylinders at the wet end of the unifelt system shown in FIG. 2.

The general arrangement of the wet end of machine 10 is illustrated in FIG. 3. As shown therein, paper P is conveyed to upper dryer 1. In the meantime fabric support sheet S meets paper P at the upper dryer 1 so that both paper sheet P and support sheet S travel together around the various upper and lower drying cylinders 1-7. After upper drying cylinders 1-7, fabric support S is separated from paper P and conveyed around its various guide rollers 22, 24 to form an endless loop. The conventional dual felt support system utilizing a pair of supports 25 (only one of which is shown) is then used with paper P as paper P continues to move through the system, as in known installations.

Figure 4:
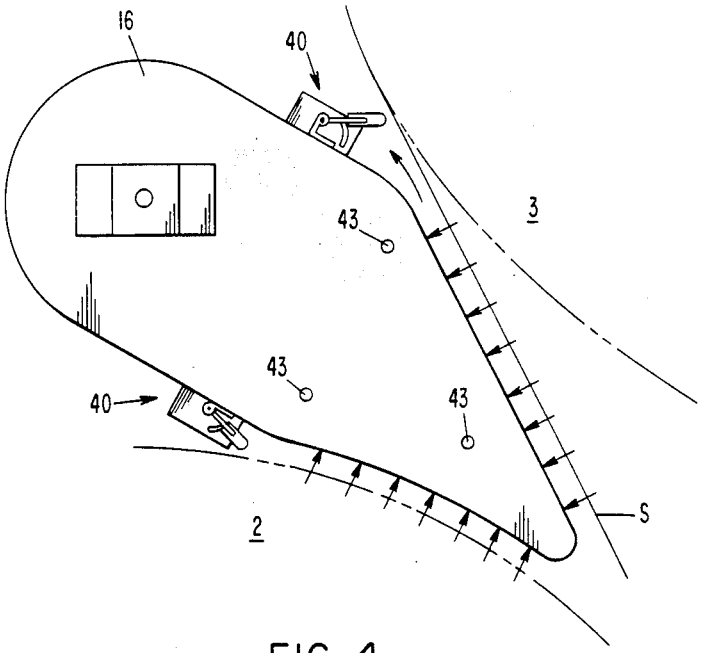
FIG. 4 is a side view in elevation from the tending side of one of the suction nozzles shown in FIGS. 2-3.
Figure 6:
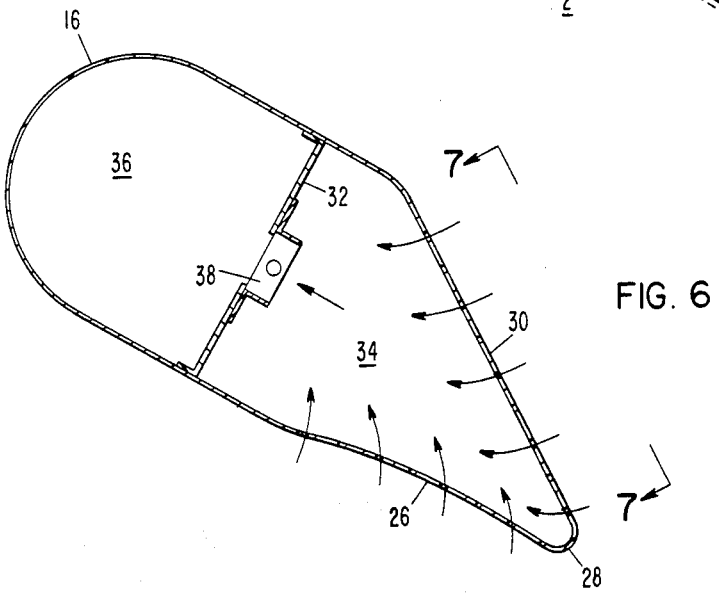
FIG. 6 is a cross-sectional view in elevation of the nozzle of FIG. 4.
Figure 7:
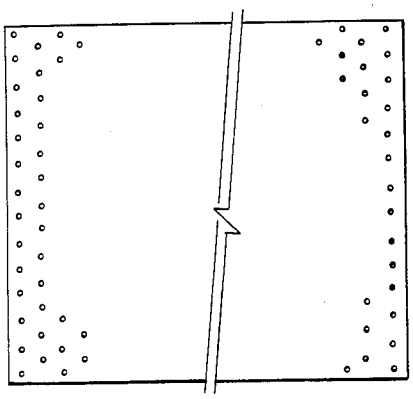
FIG. 7 is a view along the line 7—7 of FIG. 6.

FIGS. 4 and 6 illustrate the details of suction nozzle 16 in accordance with this invention. As illustrated therein, suction nozzle 16 is a hollow shell particularly shaped to conform to the adjacent surfaces encountered in the bottom pockets so as to optimize the suction action. Specifically nozzle 16 has a tapered suction end formed by an arcuate surface 26 which merges at its nose 28, and diverges along a planar surface 30. Arcuate surface 26 and planar surface 30 are perforated throughout their surfaces. FIG. 7, for example, shows the perforation pattern of planar surface 30. Nozzle 16 is of a length such as 13 feet 10 inches to correspond to the length of its drying cylinder 2.

As shown in FIG. 6, each nozzle 16 is provided with a partition 32 which extends the length of the nozzle so as to divide the nozzle into the suction zone 34 and a plenum zone 36. A central slot 38 in partition 32 provides communication between suction zone 34 and plenum zone 36. Plenum zone 36 in turn communicates with manifold 18 (FIGS. 2 and 2A). A suitable suction source 21 such as a fan, acting through duct 20 draws air through the perforations in surfaces 26 and 30 and ultimately exhausts air from the system. Central slot 38 acts as a restrictor to equalize the flow.

If desired, each nozzle 16 may also be divided by partitions 33 (FIG. 2A) at various locations along its length to divide the nozzle vertically into separate chambers and thus accommodate different flow rates along the length of the nozzle.

Arcuate surface 26 is formed along a curvature which conforms to the curvature of drying cylinder 2 whereby surface 26 remains parallel to the adjacent curved surface of cylinder 2. Similarly surface 30 is planar so as to be parallel to support sheet S. By this arrangement it is possible to insert the suction end of nozzle 16 deeply into the bottom pocket formed by sheet S and cylinder 2.

Figure 5:
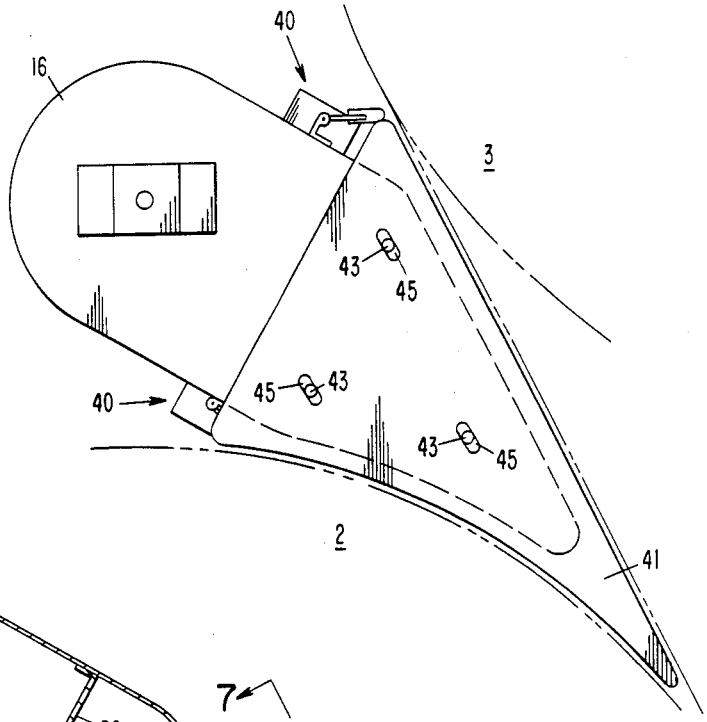
FIG. 5 is a side elevation view of an end plate usable with the suction nozzles of this invention.

In accordance with this invention the suction action is enhanced by the provision of adjustable seals 40 on each side of nozzle 16. As shown in FIG. 4, seals 40 are disposed sufficiently close to (such as ¼ inch) sheet S and cylinder 2 to form a generally closed chamber. This results not only in scooping air which might otherwise enter the pocket, but also enhances the air evacuation from the pocket by maintaining the pocket closed. To generally close the chamber at its ends, sealing partitions 41 or end plates would be provided at each end of the pocket adjustably secured to nozzle 16 by fasteners 43 in slots 45. As shown in FIG. 5, each end plate 41 has a shape conforming to the shape of the pocket. As illustrated, end plate 41 is of the same shape as, but larger than the suction end of nozzle 16.

Figure 8:
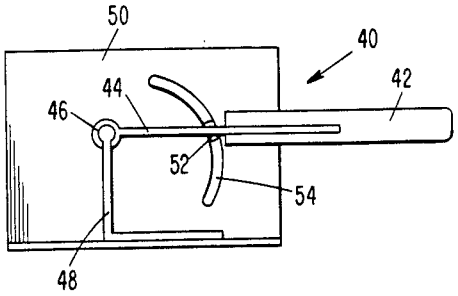
FIG. 8 is a cross-sectional view of a sealing device used with this invention.

FIG. 8 best illustrates the details of seal means 40. As illustrated therein, seal means 40 comprises a fabric material 42 which extends along the full length of nozzle 2. Fabric 42 is provided with a metal stiffener 44 which terminates just short of the outer end of fabric 42 to provide the terminal end of fabric 42 with sufficent flexibility. Stiffener 42 is pivotally mounted at end 46 to flane 48 on bracket 50 secured to nozzle 16. An adjusting screw 52 connected to stiffener 44 rides in arcuate slot 54 so that 48 so that the degree of extension of fabric 42 toward support S or cylinder 2 may be controlled with stiffener 44 pivoting about its hinged end 46.

As is apparent, the construction and form of nozzle 16 is such so as to provide an effective suction means at the bottom pockets in the wet end of the unifelt system machine and thereby effectively avoids the air bulging problem of the prior art systems.

What is claimed is:

1. In a unifelt system for the drying of paper wherein banks of upper and lower drying cylinders are arranged in alternating sequence and the paper to be dried is conveyed from the paper press and then around the cylinders in the alternating sequence of upper and lower cylinders and wherein a support sheet is conveyed around at least some of the cylinders in supporting contact with the paper, the improvement being at least one suction nozzle being located in the pocket formed between the upstreammost lower cylinder and the support sheet in the vicinity where the support sheet makes contact with said upstreammost lower cylinder, said nozzle having an arcuate surface disposed adjacent and parallel to the outer arcuate surface of said upstreammost lower cylinder, said nozzle having a planar surface diverging away from said arcuate surface for being disposed adjacent and parallel to the support sheet, a plurality of perforations throughout the length of said arcuate surface and of said planar surface of said nozzle for permitting a suction to be applied to said pocket to prevent the trapping of air in said pocket and for applying a suction to the paper and support sheet throughout their lengths corresponding to said arcuate surface; and said planar surface, and a adjustable seals on said nozzle adjustably mounted at said arcuate surface and said planar surface for selectively moving toward said lower cylinder and toward said support sheet at the open end of the pocket for forming the pocket into a generally closed chamber.

2. The system of claim 1 wherein said nozzle is of a length corresponding to the length of said upstreammost lower cylinder.

3. The system of claim 1 wherein said adjustable seal comprises an elongated stiffener extending generally the entire length of said nozzle, and a fabric secured to and extending outwardly beyond said stiffener for being flexibly disposed toward said lower cylinder and said support sheet.

4. The system of claim 3 wherein said stiffener is secured to an adjusting means for permitting said stiffener to be moved toward and away from said nozzle.

5. The system of claim 4 including an end plate secured at each end of said pocket conforming in shape to the shape of said pocket.

6. The system of claim 5 wherein each of said end plates is adjustably secured to said nozzle for movement into and out of said pocket.

7. The system of claim 1 including a generally central partition extending across said nozzle from a location on said nozzle outwardly beyond said arcuate side to a location outwardly beyond said planar side for separating said nozzle into a suction zone and a plenum zone, said perforated surfaces being located at said suction zone, and a slot in said partition for causing communication between said suction zone and said plenum zone.

8. The system of claim 2 including a plurality of dividers separating said nozzle into separate chambers along the length thereof.

9. The system of claim 1 including a separate nozzle at the pocket formed by the three upstreammost of said lower cylinders.

10. The system of claim 9 wherein said nozzles communicate with a common manifold, a duct leading outwardly from said manifold, and vacuum means communicating with said duct.

11. The system of claim 7 wherein said nozzle is dome shaped at said plenum zone.

12. A nozzle for minimizing the entrapment of air in the pocket at a bottom drying cylinder in paper manufacture or the like comprising a hollow shell being divided by a partition into a plenum zone and a suction zone, an opening in said partition for creating communication between said zones, said shell having a perforated arcuate surface, a perforated planar surface diverging away from said arcuate surface at said suction zone, the perforations extending the length of said arcuate surface and of said planar surface, and said plenum zone having connecting means for communication with a source of suction for withdrawing air through said perforated surfaces and away from said nozzle, and a adjustable seals on said nozzle adjustably mounted at said arcuate surface and said planar surface for selectively moving toward the lower cylinder and toward the support sheet at the open end of the pocket for forming the pocket into a generally closed chamber.

13. The nozzle of claim 12 wherein said adjustable seal comprises an elongated stiffener extending generally the entire length of said nozzle, and a fabric secured to and extending outwardly beyond said stiffener for flexibly contacting the lower cylinder and the support sheet.

14. The nozzle of claim 13 wherein said stiffener is secured to an adjusting means for permitting said stiffener to be moved toward and away from the outer surface of said shell.

15. The nozzle of claim 12 including an end plate adjustably mounted to each end of said nozzle, said end plate having the same shape and being of larger dimension than the portion of said shell having said suction zone.

16. The nozzle of claim 12 wherein said partition is a generally central partition extending across said nozzle from a location on said nozzle outwardly beyond said arcuate side to a location outwardly beyond said planar side for separating said nozzle into said suction zone and said plenum zone, and said opening in said partition being a slot for causing communication between said suction zone and said plenum zone.

17. The nozzle of claim 12 including a plurality of dividers separating said nozzle into separate chambers along the length thereof.

18. The nozzle of claim 16 wherein said shell is dome shaped at said plenum zone.

* * * * *